United States Patent [19]

Higgins et al.

[11] 4,301,999

[45] Nov. 24, 1981

[54] VACUUM HOLD-DOWN TABLE FOR AN AUTOMATICALLY CONTROLLED SYSTEM FOR WORKING ON SHEET MATERIAL

[75] Inventors: Bobby L. Higgins, Dallas; James A. Mann, Jr., Richardson, both of Tex.

[73] Assignee: Camsco, Inc., Richardson, Tex.

[21] Appl. No.: 73,863

[22] Filed: Sep. 10, 1979

[51] Int. Cl.[3] ..... B25B 11/00

[52] U.S. Cl. ..... 269/21

[58] Field of Search ..... 269/21; 83/451, 452, 83/925 CC; 156/285, 286, 382

[56] References Cited

U.S. PATENT DOCUMENTS

| | | | |
|---|---|---|---|
| 3,180,608 | 4/1965 | Fischer . | |
| 3,493,451 | 2/1970 | Beery | 156/382 X |
| 3,495,492 | 2/1970 | Gerber et al. . | |
| 3,598,006 | 8/1971 | Gerber . | |
| 3,672,661 | 6/1972 | Gerber et al. . | |
| 3,682,750 | 8/1972 | Gerber . | |
| 3,742,802 | 7/1973 | Maerz . | |
| 3,765,289 | 10/1973 | Gerber et al. . | |
| 3,777,604 | 12/1973 | Gerber . | |
| 3,790,154 | 2/1974 | Gerber et al. . | |
| 3,841,187 | 10/1974 | Gerber et al. . | |
| 3,848,327 | 11/1974 | Gerberet al. . | |
| 4,049,484 | 9/1977 | Priest et al. | 269/21 X |

*Primary Examiner*—Robert C. Watson

*Attorney, Agent, or Firm*—Richards, Harris & Medlock

[57] ABSTRACT

A vacuum hold-down table (36) is provided for holding sheet material (40) in place. The vacuum hold-down table (36) includes a plurality of foam layers (542, 544, 546, 548, 550, 552) integrally united to form a laminated monolithic core portion (560) for the table (36). A plurality of apertures (580) extend throughout the core portion (560), such that air flows throughout the core portion (560). A vacuum is provided through structure (608, 610) to the core portion (560) to effectuate a vacuum within the core portion (560) to generate a high flow rate of air passing through the apertures (480) and thereby maintain sheet material (40) on the surface (38) of the table (36).

7 Claims, 10 Drawing Figures

VACUUM HOLD-DOWN TABLE FOR AN AUTOMATICALLY CONTROLLED SYSTEM FOR WORKING ON SHEET MATERIAL

TECHNICAL FIELD

This invention relates to hold-down mechanisms and, more particularly to a vacuum hold-down table for maintaining sheet material in place for use in an automatically controlled system for working on sheet material.

BACKGROUND ART

Automatically controlled instrument systems having carriages which move in two coordinate directions over a work surface of a table are well-known. Typically, a first carriage traverses the table in one coordinate direction parallel to the work surface and a second carriage mounted on the first carriage moves relative to the first carriage in the other coordinate direction. When an instrument is mounted on the second carriage, composite movement of both carriages allow the instrument to be translated to any point over the region of the work surface traversed by the carriages. Accurate positioning of the carriages and, consequently, of the instrument, is achieved by numerical controls which may operate either from an on-line data generator or from previously programmed data. Such a numerical control system is described in U.S. Pat. No. 3,887,903 issued to Martell on June 3, 1975 and entitled "Interactive Man-Machine Method and System for Grading Pattern Pieces and for Producing an Apparel Marker" assigned to the assignee of the present invention.

Sheet material, such as fabric and plastics to be cut or paper on which graphical data is plotted, is placed on the work surface of the table associated with automatically controlled instrument systems which perform cutting and plotting functions. In such systems it is necessary to hold the sheet material in place before cutting or plotting begins in addition to holding cut pieces from the sheet material after the cutting instrument has passed over a portion of the sheet material.

Previously developed hold-down techniques have utilized a vacuum which is applied to a table associated with an automatically controlled instrument system. Such systems are illustrated in U.S. Pat. No. 3,180,608 issued to Fischer on Apr. 27, 1965 and entitled "Vacuum Holding of Thin Pliable Material"; U.S. Pat. No. 3,765,289 issued to Gerber et al on Oct. 16, 1973 and entitled "Vacuum Hold-Down Apparatus"; and U.S. Pat. No. 3,815,221 issued to Pearl on June 11, 1974 and entitled "Method for Holding Sheet Material by a Vacuum HoldDown". Additionally, previously developed vacuum hold-down techniques have utilized an air impermeable sheet placed over the sheet material to be cut in order to maintain the sheet material in a fixed position such that when a vacuum is applied, the vacuum produces forces against the air impervious material to compress and hold the sheet material before cutting. Such systems are illustrated in U.S. Pat. No. 3,598,006 issued to Gerber et al. on Aug. 10, 1971 and entitled "Method for Working on Sheet Material and Other Objects" and U.S. Pat. No. 3,742,802 issued to Maerz on July 3, 1973 and entitled "Sheet Material Cutting Apparatus Including a Vacuum HoldDown System Having a Roller Mechanism for Handling Air-Impermeable Sheets". Additionally, mechanical hold-down techniques have been utilized, as illustrated in U.S. Pat. No. 3,841,187 issued to Gerber et al on Oct. 15, 1974 and entitled "Method and Apparatus for Holding Sheet Material".

Although vacuum hold-down techniques, in combination with mechanical techniques, have been generally utilized for maintaining sheet material in a fixed position on a work table, such previously developed systems have not provided uniform vacuum pressure over the surface of a work table nor a vacuum of sufficient strength to maintain the work piece and cut pieces fixed without employing an additional hold-down sheet over the sheet material being worked upon. Additionally, such previously developed systems have suffered from vacuum loss after sheet material is cut which results in a reduction in the holding and compacting efficiency of the vacuum hold-down system. One suggested technique of preventing a reduction in vacuum loss is illustrated in U.S. Pat. No. 3,682,750 issued to Gerber on Aug. 8, 1972 and entitled "Cutting Apparatus With Vacuum Hold-Down and Cut Sealing Means" in which tape is applied to cuts to join cut pieces together, thereby maintaining a continuous sheet of material over the work surface to maintain vacuum pressure.

Previously developed hold-down systems have also required that the entire work surface be covered with sheet material in order for sufficient vacuum pressure to be generated in order to maintain the sheet material in position. Such systems do not have the capability of maintaining pieces of sheet material of a size less than the entire work surface of a table in a fixed position.

An additional problem associated with previously developed vacuum hold-down systems is the degree of flatness of the work surface of the table. In automatically controlled instrument systems, it is essential that the work surface be flat to insure proper operation of the carriages and operating instruments. Such tables must be immune to warpage and contour changes due to humidity conditions.

A need has thus arisen for a vacuum hold-down system and table for use in an automatically controlled instrument system in which vacuum pressure, without the need for mechanical aids, is generated of sufficient strength to maintain sheet material in a fixed position on a work surface. Such a system must be capable of holding pieces which have been cut from a large piece of sheet material in addition to holding sheet material which is smaller in size than the entire area of the work surface. Additionally, such a system must include a table that is not susceptible to warpage due to humidity changes in the environment to insure a flat work surface. In such a vacuum hold-down system, a need has further arisen for a vacuum system that creates a high, more evenly distributed flow rate through the table with low vacuum pressure. Additionally, a need has arisen for a table for use with an automatically controlled instrument system that is lightweight and economical to manufacture and maintain. Further, a need has arisen for a method of manufacturing a table that has a flat work surface.

DISCLOSURE OF THE INVENTION

In accordance with the present invention, a vacuum hold-down table for use with an automatically controlled instrument system is provided which substantially eliminates the problems heretofore associated with vacuum hold-down tables including maintenance of sufficient vacuum pressure and table flatness.

In accordance with the present invention, a vacuum hold-down table for holding sheet material is provided. The vacuum hold-down table includes a plurality of layers integrally united to form a laminated monolithic body for the table. A plurality of apertures extend throughout the body, such that air flows through the body. A nonporous surface is provided for the table top. A vacuum source is provided and structure applies the vacuum source to the body to effect a vacuum within the body to generate a high differential pressure between the body and the table top to maintain the sheet material in a fixed position.

In accordance with another aspect of the present invention, a vacuum hold-down table for holding sheet material in place is provided. The vacuum hold-down table includes a plurality of foam layers integrally united to form a laminated monolithic core portion for the table. The core portion has top and bottom surfaces. A first layer of rigid material is provided having top and bottom surfaces wherein the bottom surface is disposed adjacent the top surface of the core portion and is integrally united to the core portion. A second layer of rigid material is provided having top and bottom surfaces wherein the top surface is disposed adjacent the bottom surface of the core portion and is integrally united to the core portion. The core portion of the vacuum hold-down table and the first and second layers form a body portion for the table. A plurality of apertures extend throughout the body portion, such that air can flow through the body portion. A relatively air impervious layer of material is also provided and is disposed adjacent the first layer of rigid material to form a top surface of the table. A vacuum source is provided and structure applies the vacuum source to the body portion to effect a vacuum within the body portion to maintain sheet material in place.

In accordance with another aspect of the present invention, a method of manufacturing a table having a relatively flat work surface is provided. The method includes the step of placing a first layer of material comprising the work surface of the table adjacent a flat reference surface. A plurality of structural layers to provide support for the work surface are placed above the first layer. A bonding agent is deposited between the layers. A nonporous enclosure is then placed around the reference surface and the layers. Vacuum pressure is applied to the nonporous enclosure to create a suction effect within the enclosure by which the layers are forced downwardly toward the flat reference surface such that the first layer of material assumes the surface characteristics of the flat reference surface.

BRIEF DESCRIPTION OF DRAWINGS

For a more complete understanding of the present invention and for further objects and advantages thereof, reference is now made to the following Detailed Description taken in conjunction with the accompanying Drawings in which.

DETAILED DESCRIPTION

Figure 1:
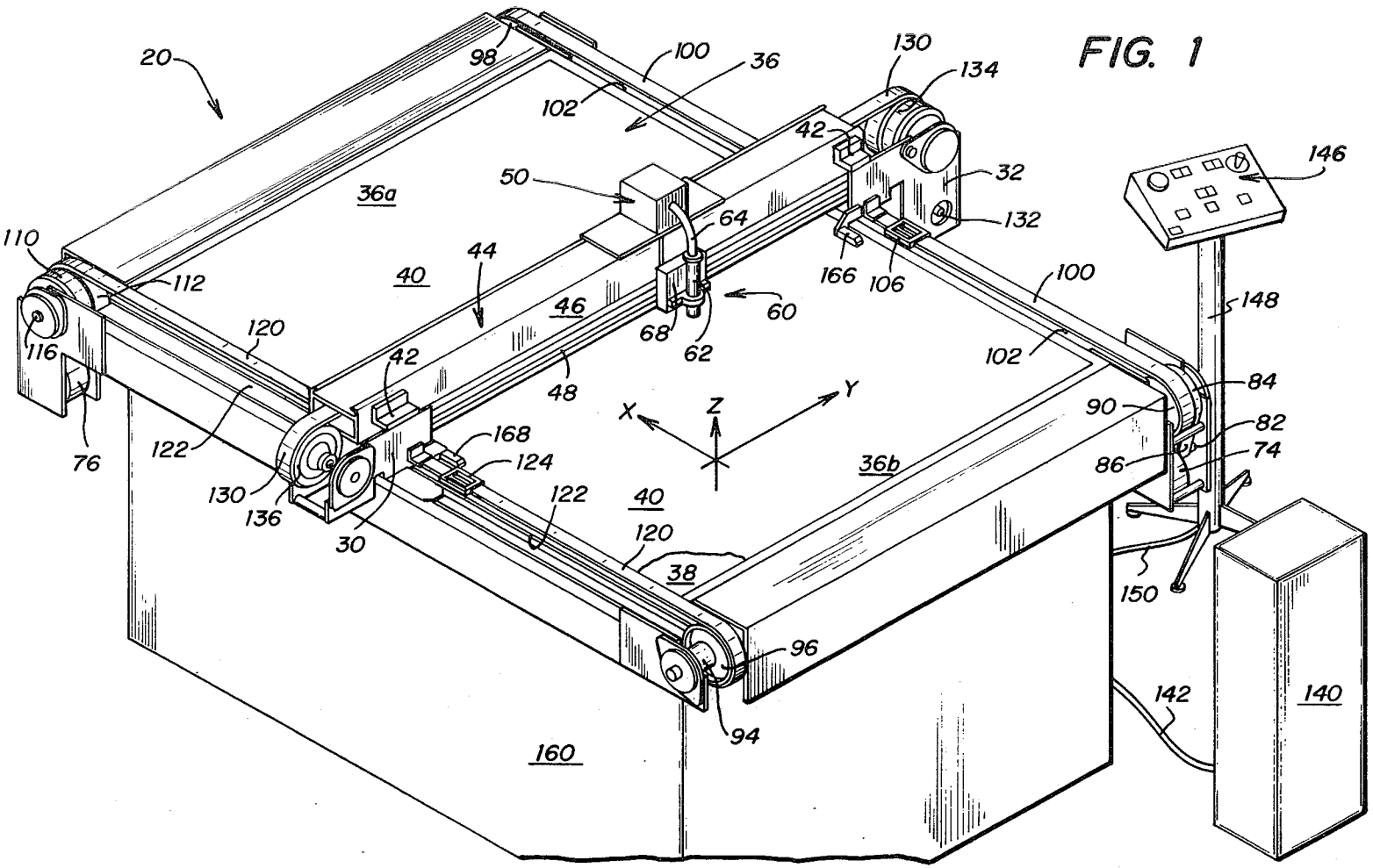
FIG. 1 is a perspective view of an automatically controlled instrument system utilizing the vacuum hold-down table of the present invention.

Referring to FIG. 1, a perspective view of the automatically controlled instrument system for use with the present vacuum hold-down table is illustrated and is generally identified by the numeral 20. Automatically controlled instrument system 20 may be utilized as illustrated in FIG. 1, to cut sheet material which as used herein includes, for example, cloth, fabric, plastic, foil, wood or other material which is held in a fixed position so that a predetermined line of cut can be accurately traversed through the sheet material by a cutting tool during the cutting operation. The sheet material may be of a single ply or multi-ply in a layup.

Additionally, automatically controlled instrument system 20 may also be used as a plotter for plotting a graphical representation of informational data on paper. Although a cutting system has been selected for illustration of the present vacuum hold-down, the invention can be employed in any type of automatically controlled system having an instrument supported in a carriage for precise positioning over sheet material that is held stationary relative to the carriage during operation of the instrument. As used herein, an instrument will include either a cutting device or a plotting device and includes such instruments as, for example, plotting pens or styli, ink jet printers, knives, routers, water jet and flame cutters, laser cutters and various other instruments. Differences between operation of the present automatically controlled instrument system 20 in a cutting or plotting mode will be noted where required throughout this Description.

Automatically controlled instrument system 20 includes a pair of longitudinal carriages 30 and 32 which are mounted adjacent the vacuum hold-down table of the present invention generally identified by the numeral 36. Table 36 will be subsequently described with reference to FIGS. 9 and 10. Table 36 includes a work surface 38 for supporting sheet material 40. Carriages 30 and 32 mount to and index on table 36 for slidable movement along the longitudinal or X coordinate direction to traverse vacuum hold-down table 36.

Carriages 30 and 32 support a beam generally identified by the numeral 44 which is attached to carriages 30 and 32 through brackets 42. Beam 44 is composed of an upper beam member 46 and a lower beam member 48. The construction of beam 44 will be subsequently described with reference to FIG. 4. Beam 44 supports a lateral carriage generally identified by the numeral 50 which is supported within beam 44 for slidable movement therein. Carriage 50 moves in a direction transverse to movement of carriages 30 and 32 to cross table 36 in a direction perpendicular to movement of carriages 30 and 32 or in a Y coordinate direction relative to vacuum hold-down table 36.

Carriage 50 supports an instrument carrier generally identified by the numeral 60, which is shown for illustrative purposes only in FIG. 1, as a router cutter 62. Carrier 50 includes associated components for providing air pressure through a tube 64 to router cutter 62 and for supplying air pressure to a lift mechanism 68 associated with instrument carrier 60. Lift mechanism 68 will be subsequently described with reference to FIGS. 4–6. Lift mechanism 68 functions to permit the instrument carried by carrier 50 to move perpendicular to surface 38 of table 36 or in a Z coordinate direction relative to table 36.

A drive mechanism for controlling movement of carriages 30, 32 and 50 of automatically controlled instrument system 20 will now be discussed. A servo drive motor 74 is mounted to table 36 at one corner and a servo drive motor 76 is mounted to table 36 at a diagonally positioned corner. Alternatively, servo drive motors 74 and 76 can be positioned on the same side of table 36. However, it has been found that the symmetrical placement of drive motors 74 and 76 provide for a more mechanically sound system in which tensions are equalized, as will subsequently be described. Drive motors 74 and 76 are electrically wired in series, such that drive motors 74 and 76 operate essentially as one motor since the same amount of current is drawn by each of the drive motors 74 and 76. Drive motors 74 and 76 may comprise, for example, Type U9M4 air cooled motors manufactured by Printed Motors Inc. of Syossett, New York.

Drive motor 74 is coupled through its output shaft 82 and a drive belt 84 to a drive pulley 86 at table end 36B. Drive pulley 86 is interconnected to a band roller 90 which is received by a torque tube 94. The opposite end of torque tube 94 receives a band roller 96.

Disposed at table end **36*a* of table 36 is a band roller 98, which together with band roller 90, receives a band 100. Band 100 is slidable within a bandway or track 102 and supports carriage 32 for slidable movement in the X coordinate direction along table 36. Band 100 is formed from a continuous strip of metal, such as, for example, stainless steel and is joined at its end by a tensioner 106. Tensioner 106 maintains the proper tension or stiffness in band 100**.

In a similar manner, drive motor 76 causes rotation of a drive pulley 110 for rotation of a band roller 112. Band roller 112 is supported by a torque tube 116 which imparts rotational motion to band roller 98 which supports band 100. Band roller 112 together with band roller 96 support a band 120 received within a bandway 122. Band 120 is constructed of similar material as band 100 and is joined at its end by a tensioner 124 and supports carriage 30 for slidable movement in the X coordinate direction along table 36. It therefore can be seen that through the simultaneous movement of bands 100 and 120, carriages 30 and 32 simultaneously move beam 44 in the X coordinate direction along table 36. Tensioners 106 and 124 function to maintain a preselected constant tension on bands 100 and 120.

Beam 44 includes a band 130 which is driven by a motor 132. Band 130 is supported on a band roller 134 and a band roller 136. As will be more clearly illustrated in FIG. 4, instrument carrier 60 is mounted to band 130 for movement across table 36 in the Y coordinate direction between carriages 30 and 32.

Positioning of instrument carrier 60 is controlled through operation of drive motors 74, 76 and 132 which receive commands from a control computer 140 which contains information defining the path or lines of cut or plot to be followed by instrument carrier 60. Such a system is described in U.S. Pat. No. 3,887,903 issued to Martell on June 3, 1975 and entitled "Interactive Man-Machine Method and System for Grating Pattern Pieces and Producing an Apparel Marker". Commands from control computer 140 are applied to automatically controlled instrument system 20 by a cable 142. Additionally, operator commands are input to automatically controlled instrument system 20 through a control panel generally identified by numeral 146 mounted to a stand 148. Signals from control panel 146 are applied via a cable 150 to automatically controlled instrument system 20.

Vacuum hold-down table 36 is mounted to a frame 160 which will subsequently be described with reference to FIGS. 6, 7 and 8. Automatically controlled instrument system 20 also receives cables (not shown) for supplying electrical power and air pressure.

Also illustrated in FIG. 1 are scrapers 166 and 168 for maintaining bandways 102 and 122 free of debris and cut material that may be generated during the cutting operation of automatically controlled instrument system 20. Additionally, a barrier of bristles may be interposed between the edge of work surface 38 of table 36 and bandways 102 and 122.

The drive system of automatically controlled instrument system 20, including drive motors 74, 76 and 132 together with bands 100, 120 and 130 and associated components, provide for a highly accurate positioning system for an instrument such as router cutter 62 carried by instrument carrier 60. The drive mechanism is simple in construction and maintenance free for reduced manufacturering and operating costs. The use of bands 100, 120 and 130 raises the effective stiffness of the present drive mechanism such that slack and backlash are effectively eliminated in the operation of the present automatically controlled instrument system 20. There is essentially immediate response in the movement of carriages 30, 32 and 50 upon operation of drive motors 74, 76 and 132. Such immediate response is necessary for accurate positioning of instrument carrier 60 to carry out the desired cutting or plotting operation of automatically controlled instrument system 20.

Figure 2:
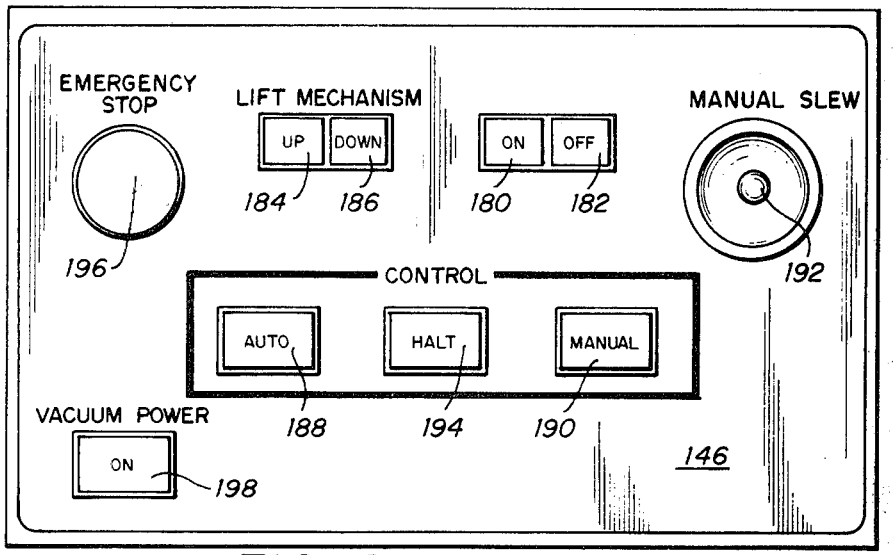
FIG. 2 is a plan view of a control panel utilized with the automatically controlled instrument system illustrated in FIG. 1.

Referring simultaneously to FIGS. 1 and 2, the operation of control panel 146 will now be discussed. Control panel 146 includes an on push button switch 180 and an off push button switch 182 to enable an operator to apply power to automatically controlled instrument system 20. Push button switches 184 and 186 are provided for raising and lowering the position of instrument carrier 60. For the up position, push button switch 184 will be illuminated and for the down position, push button switch 186 will be illuminated. A push button switch 188 is provided to allow the operator to place automatically controlled instrument system 20 in an automatic mode of operation for computer control of the system. A push button switch 190 allows a manual mode of operation for automatically controlled instrument system 20 through the use of a control stick 192 that provides a combination on-off control to an operator to slew instrument carrier 60 to any position within table 36. A push button switch 194 allows the operator to halt the operation of automatically controlled instrument system 20 at any point during the cutting or plotting operation. An emergency stop control switch 196 interrupts electrical power to the entire automatically controlled instrument system 20 while a push button switch 198 interrupts electrical power supplied to the vacuum hold-down system of table 36.

Figure 3:
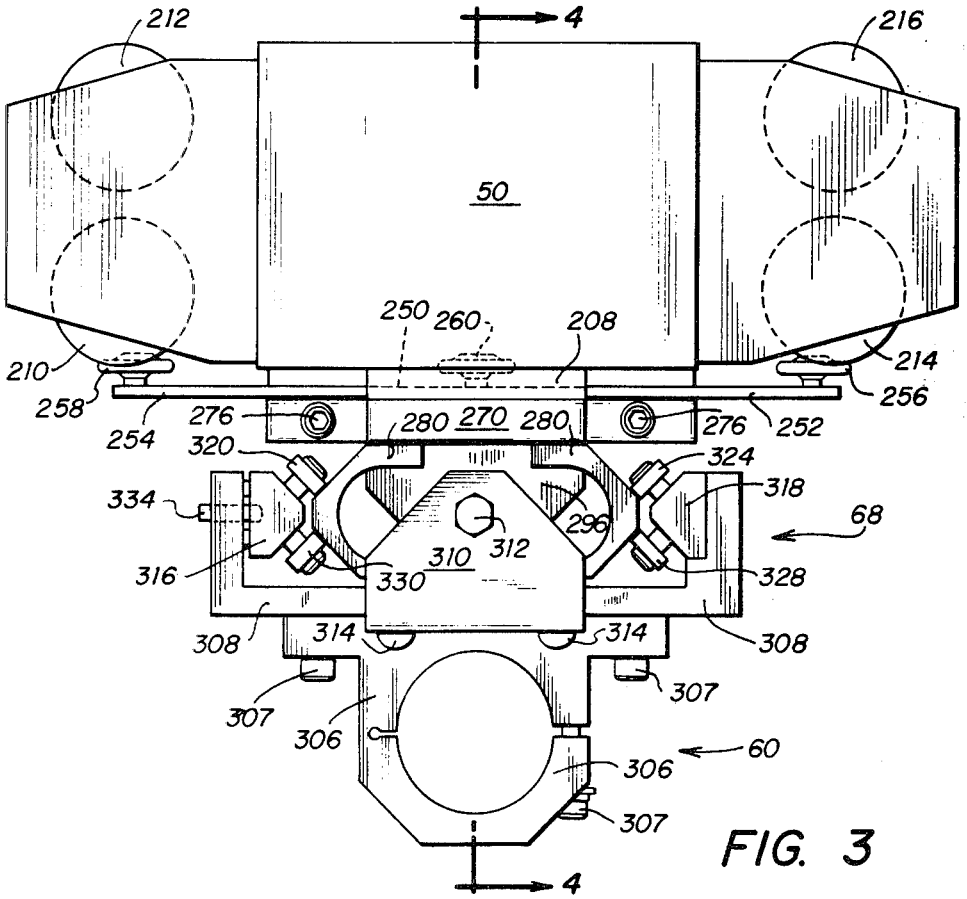
FIG. 3 is an enlarged top plan view of an instrument carrier utilized with the automatically controlled instrument system illustrated in FIG. 1.
Figure 4:
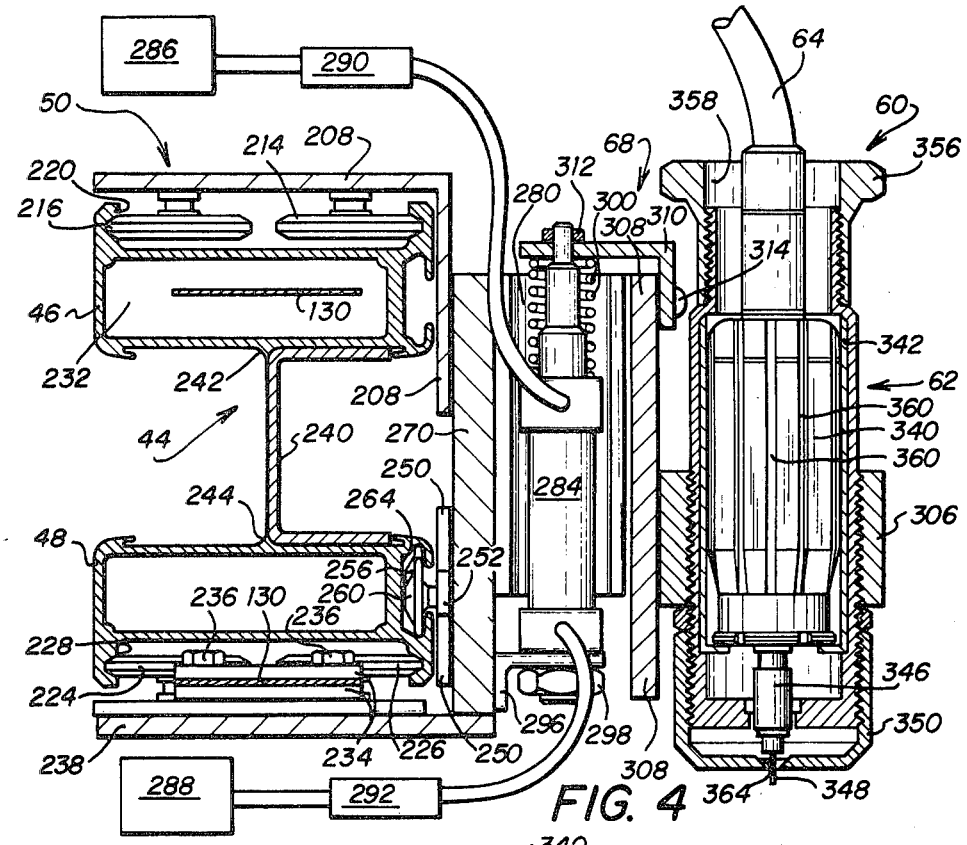
FIG. 4 is a sectional view taken generally along sectional lines 4—4 of FIG. 3 illustrating a cutter instrument carried by the instrument carrier illustrated in FIG. 3.
Figure 5:
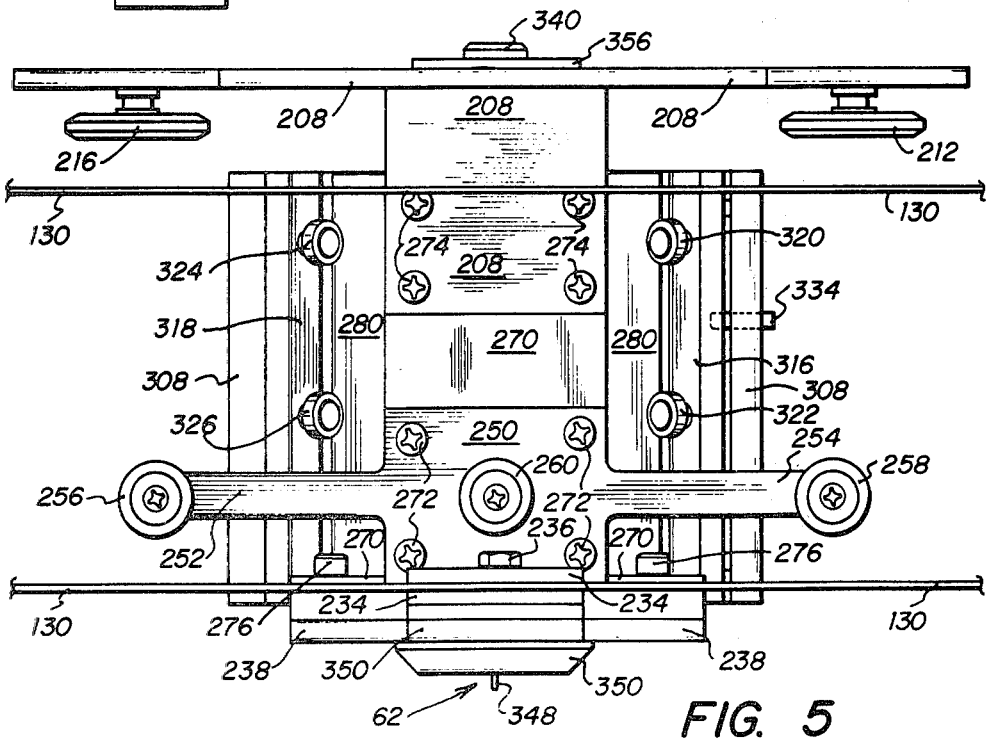
FIG. 5 is a rear elevational view of the instrument carrier illustrated in FIG. 3.

Referring simultaneously to FIGS. 3–5, instrument carrier 60 and lift mechanism 68 will now be described. Carriage 50 includes a bracket 208. Wheels 210, 212, 214 and 216 are attached to bracket 208 and engage a rail 220 disposed within upper beam member 46 of beam 44. Carriage 50 further includes wheels 224 and 226 and a second set of wheels (not shown) for engaging a rail 228 disposed within lower beam member 48 of beam 44. Wheels 210, 212, 214, 216, 224 and 226 frictionally engage rails 220 and 228 of beam 44 for rolling movement therein. Upper beam member 46 defines a bandway 232 for band 130. Band 130 is disposed below lower beam member 48 of beam 44 and is rigidly attached to carriage 50 mounted between plates 234 using bolts 236 mounted to a bracket 238. Disposed between upper and lower beam members 46 and 48 is a C-channel 240 which abuts against ribs 242 and 244 for maintaining proper spacing between upper and lower beam members 46 and 48.

Lift mechanism 68 includes a wheel support member 250 having arms 252 and 254. Attached to the end of arm 252 is a wheel 256 and attached to the end of arm 254 is a wheel 258. Wheels 256 and 258 are disposed along a common axis. Wheel support member 250 further includes a wheel 260 disposed slightly below the axis of wheels 256 and 258. Wheels 256, 258 and 260 are disposed within a rail 264 (FIG. 4) within lower beam member 48. Due to the offset positioning of wheel 260 compared to wheels 256 and 258, an interference fit occurs between wheel support member 250 and rail 264 such that arms 252 and 254 of wheel support member 250 act as a spring to positively engage wheel support member 250 with beam 44 for movement thereon.

Wheel support member 250 is mounted to a bracket 270 using screws 272. Bracket 208 of carriage 50 is mounted to bracket 270 using screws 274 and bracket 238 is mounted to bracket 270 using screws 276.

Mounted to bracket 270 is a housing 280 for lift mechanism 68. Housing 280 includes an air cylinder 284 mounted therein for controlling the vertical position in the Z coordinate direction of the instrument being carried by instrument carrier 60. Air cylinder 284 maintains an adjustible constant force between the instrument being carried by instrument carrier 60 and the surface of the sheet material being cut. Air cylinder 284 is a double acting air cylinder having one piston (not shown). Air is supplied to air cylinder 284 to actuate the piston from air supplies 286 and 288. Air is adjustably supplied to the upper side of the piston (not shown) from air supply 286 through a regulator 290 for maintaining a downwardly directed force applied to instrument carrier 60. Air is adjustably supplied to the lower side of the piston (not shown) through a regulator 292 from air supply 288 for maintaining an upwardly directed force applied to instrument carrier 60. The use of air cylinder 284 permits instrument carrier 60 to essentially float on the surface of the sheet material being cut or plotted upon to compensate for irregularities in the contour of work surface 38 of vacuum hold-down table 36 (FIG. 1) or irregularities in the surface of the sheet material 40. Air cylinder 284 may comprise, for example, a double acting air cylinder, Model 01.5DX manufactured and sold by Bimba Manufacturing Company of Monee, Illinois. Control is provided by a four-way air piloted electric air valve with air supply 286 and may comprise, for example, Model R481 manufactured and sold by Clippard Instrument Laboratory, Inc. of Cincinnati, Ohio.

Air cylinder 284 is mounted to bracket 270 using a mounting bracket 296 and a nut 298. A spring 300 is disposed around air cylinder 284 to neutralize the weight of router cutter 62 and prevent router cutter 62 from engaging the surface of sheet material 40 when no cutting operation is taking place.

Instrument carrier 60 threadedly engages a mounting bracket 306 attached to a plate 308 using screws 307. Plate 308 is attached to air cylinder 284 using a bracket 310, nut 312 and screws 314 (FIG. 3) to permit instrument carrier 60 to move upwardly and downwardly in the Z coordinate direction under the control of air cylinder 284. Plate 308 includes support surfaces 316 and 318 for receiving ball bearings 320, 322, 324 and 326 (FIG. 5) and ball bearings 328 and 330 (FIG. 3) and two additional ball bearings (not shown) for engaging housing 280 of air cylinder 284. The engaging surface of housing 280 is a hard anodized surface to provide a low friction surface for movement of ball bearings 320, 322, 324, 326, 328 and 330. Support surface 318 is rigidly attached to plate 308 while support surface 316 is detachably mounted for adjustment purposes using a screw 334.

As illustrated in FIG. 4, instrument carrier 60 includes a router cutter 62. Router cutter 62 includes an air turbine 340 disposed within a sleeve 342 within instrument carrier 60. Air turbine 340, in the preferred embodiment, rotates at an extremely high rpm. Air turbine 340 includes a collet 346 which holds a cutting tip 348. Cutting tip 348 is enclosed within a presser foot 350 which threadedly engages instrument carrier 60. Instrument carrier 60 further includes a cap 356 which also threadedly engages instrument carrier 60. Cap 356 includes an aperture 358 for receiving tube 64 which supplies air from a source to air turbine 340. The exhaust from air turbine 340 escapes from the lower end of air turbine 340 through grooves 360 within the surface of air turbine 340 through aperture 358 within cap 356. A smaller amount of exhaust exits instrument carrier 60 through an aperture 364 formed within presser foot 350 to clean cutting tip 348.

Figures 6, 10:
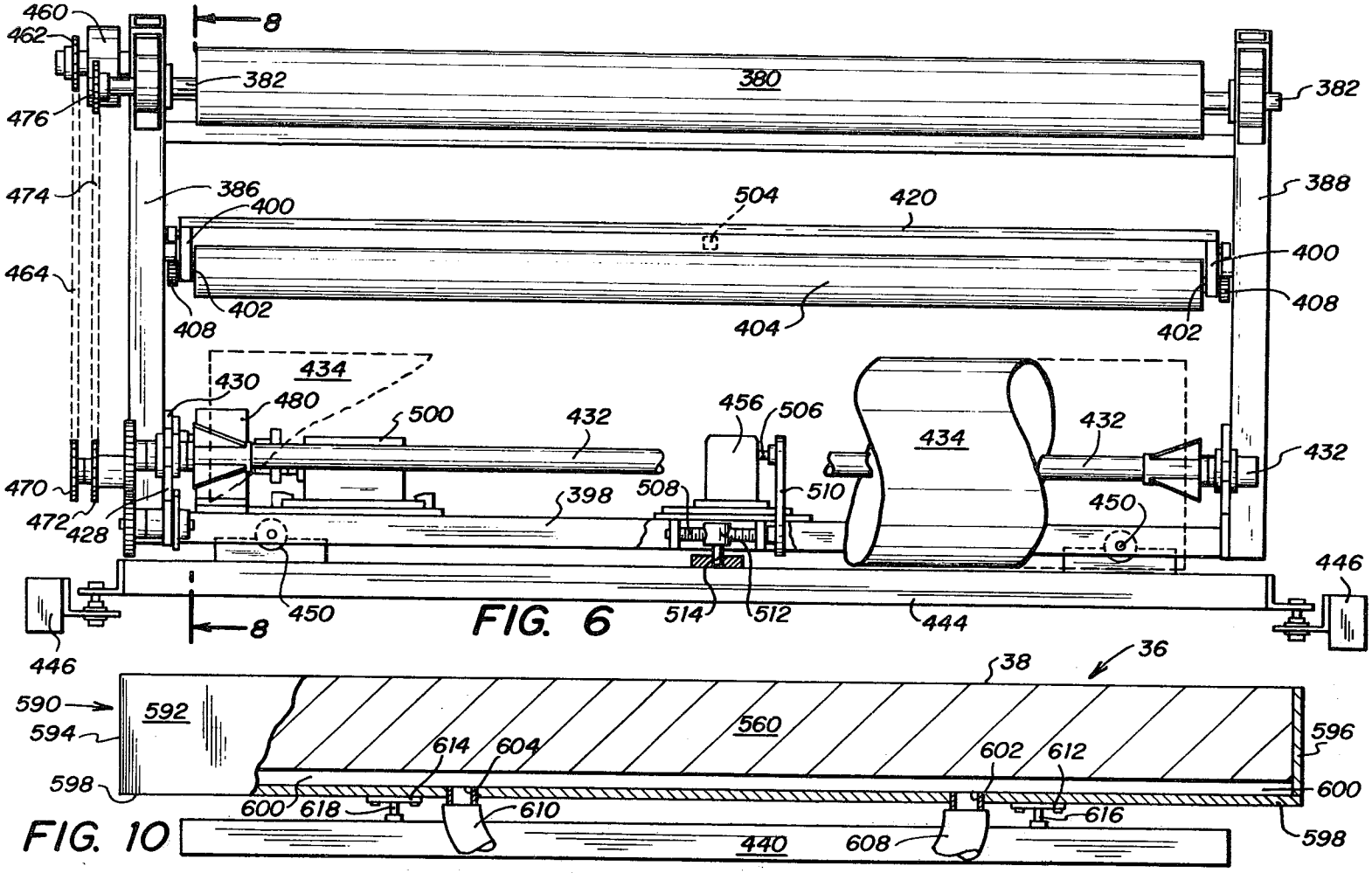
FIG. 6 is an end view of a paper feed drive mechanism utilized with the automatically controlled instrument system illustrated in FIG. 1.
FIG. 10 is a side elevational view of the vacuum hold-down table of the present invention.
Figure 7:
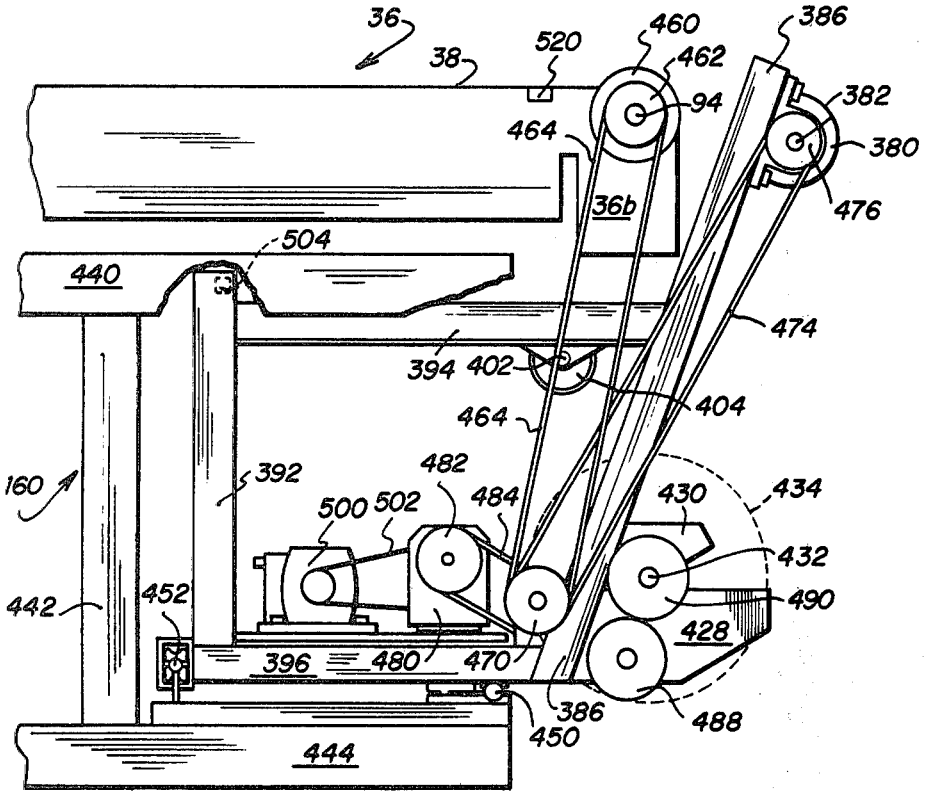
FIG. 7 is a side elevational view of the paper feed drive mechanism illustrated in FIG. 6.
Figure 8:
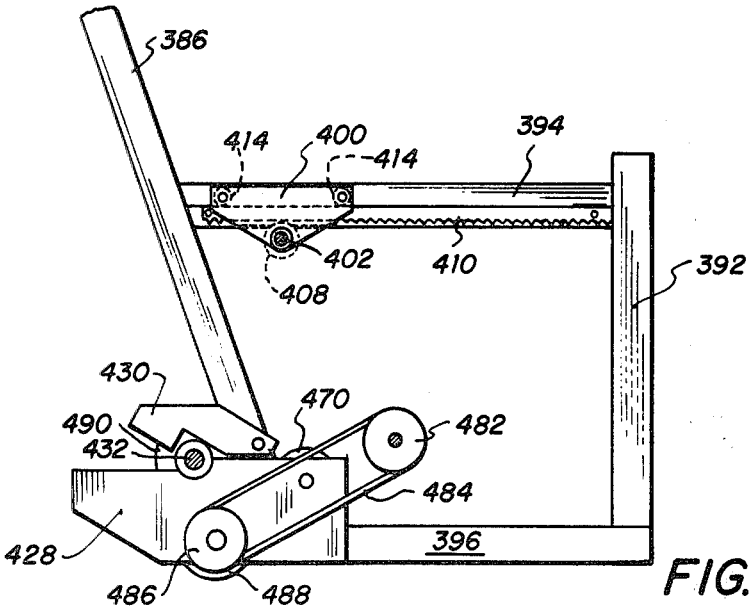
FIG. 8 is a sectional view taken generally along sectional lines 8—8 of FIG. 6 illustrating the paper feed drive mechanism of FIG. 6.

Referring simultaneously to FIGS. 6, 7 and 8, a paper drive feed system and frame 160 associated with automatically controlled instrument system 20 in the plotting mode of operation is illustrated. In the plotting mode of operation where instrument carrier 60 includes an ink jet printer, an electrostatic hold-down method for retaining paper may be utilized with table 36 in place of the vacuum hold-down method.

Referring initially to FIG. 6, a paper feed roller 380 is carried on a shaft 382 which is rotatably mounted in frame members 386 and 388. A vertical frame member 392 (FIG. 7) extends between horizontal frame members 394 and 396. A horizontal frame member 398 extends between frame members 386 and 388. Mounted to a plate 400 (FIG. 8) is a shaft 402 for supporting a dancer roller 404 between frame members 386 and 388. Shaft 402 includes a pinion gear 408 for mating with a rack 410 interconnected to horizontal frame member 394. Plate 400 includes rollers 414 (FIG. 8) such that plate 400 is slidable along horizontal frame member 394. Also disposed on plate 400 is a paper feed guide 420

(FIG. 6) extending between frame members 386 and 388.

Frame member 386 includes a mounting plate 428 and a mounting plate 430. A shaft 432 is interconnected to mounting plates 428 and 430 for supporting a roll of paper 434. Frame members 386, 392 and 396 are supported within a main frame structure including frame member 398, horizontal main frame member 440, main vertical frame member 442 and a base main frame member 444. Base main frame member 444 is interconnected to adjustable leveling feet 446 (FIG. 6). Frame member 396 is supported on rollers 450 and 452 for slidable movement with respect to base member 444 under the control of a motor 456 whose operation will be subsequently described.

Referring to FIG. 7, drive for the paper feed mechanism is provided through operation of drive motors 74 and 76 (FIG. 1). Attached to torque tube 94 is an electric clutch 460 which rotates a sprocket 462. Sprocket 462 engages a chain 464 which engages a sprocket 470. Rotation of sprocket 470, in turn, rotates a sprocket 472 (FIG. 6) which drives a chain 474 which, in turn, rotates a sprocket 476. Rotation of sprocket 476 drives shaft 382 to cause rotation of paper feed roller 380. Shaft 382 is thereby rotated at a constant speed through operation of drive motors 74 and 76 (FIG. 1).

A motor 480 provides drive for shaft 432 of paper roll 434. Motor 480 rotates a sprocket 482 which engages a chain 484. Chain 484 engages a sprocket 486 (FIG. 8) which, in turn, rotates a sprocket 488 (FIG. 7). Sprocket 488, in turn, drives a sprocket 490 to cause rotation of shaft 432. The speed at which motor 480 is operated is controlled by a variable transformer 500 which drives motor 480 through a belt 502. Control for variable transformer 500 is provided through an optical sensor 504 positioned on frame member 392. Sensor 504 senses the position of dancer roller 404 as an indication of the tension which the paper is being fed between dancer roller 404 and paper feed guide 420.

Lateral movement of frame member 398 which, in turn, positions the edge of the paper with respect to surface 38 of vacuum hold-down table 36, is controlled by motor 456. Motor 456 rotates a shaft 506 to rotate a worm shaft 508 coupled through a pulley 510. Rotation of worm shaft 508 causes shaft 508 to thread through a follower 512 to laterally move and impart lateral movement to frame member 398. Shaft 514 acts as a stop for follower 512. Control of motor 456 is provided through a pair of edge sensors 520 (FIG. 7) responsive to air pressure and being disposed adjacent top surface 38 of vacuum hold-down table 36. Edge sensors 520 may comprise, for example, a pressure switch Model PSF 103A-2 manufactured by Fairchild Industrial Products of Commack, New York. Edge sensors 520 are responsive to air pressure directed at the edge of the paper for providing a signal to motor 456.

A similar feed mechanism to that illustrated at table end 36B in FIGS. 6, 7 and 8 is provided at end **36*a* of vacuum hold-down table 36 to reroll paper after it has passed over the surface 38 of vacuum hold-down table 36 and the plotting operation has been completed. The take-up mechanism does not utilize a clutch 460 and therefore the drive system of the present invention cannot be operated to feed paper from end 36*a* of vacuum hold-down table 36**.

Figure 9:
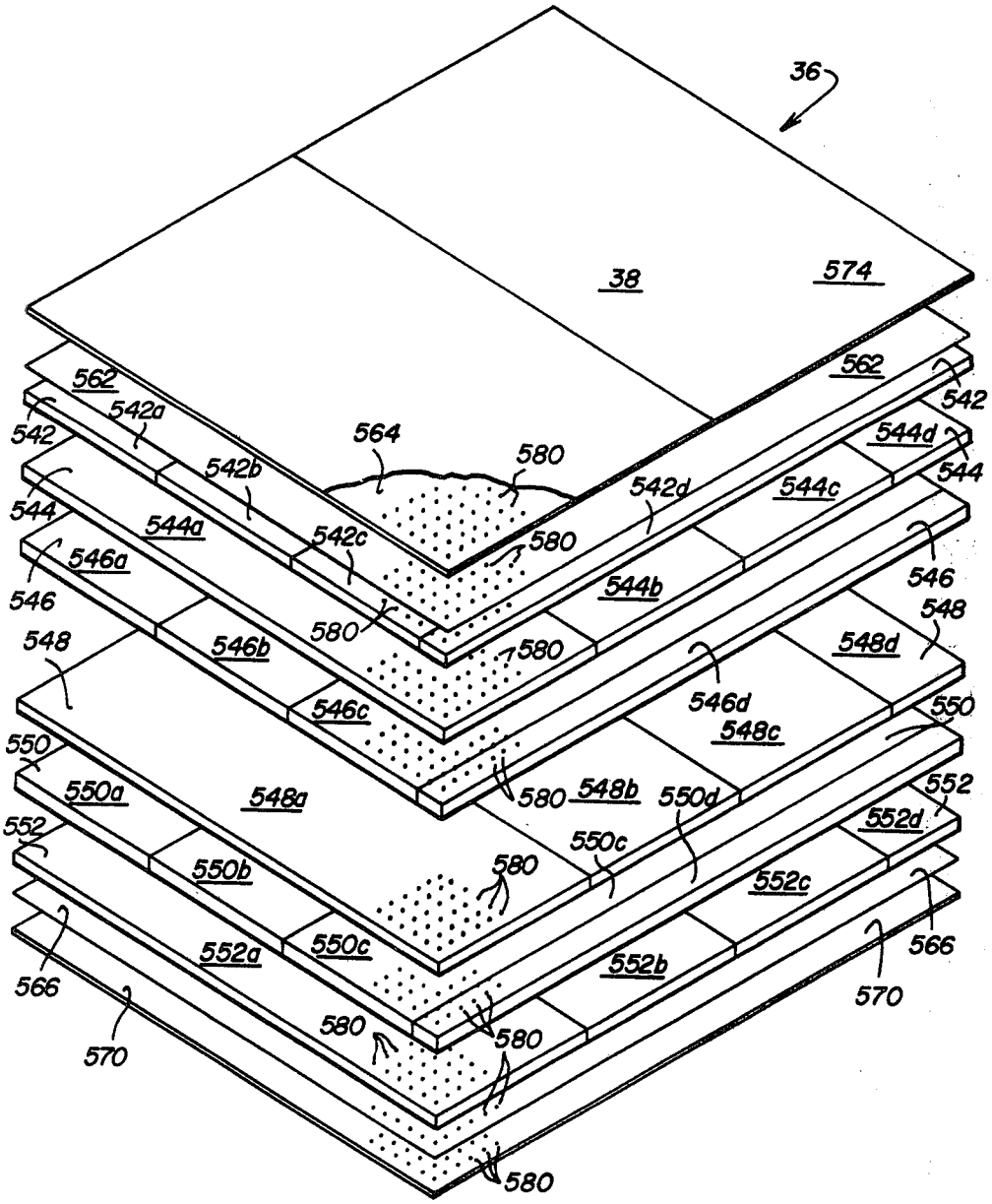
FIG. 9 is an exploded perspective view of the vacuum hold-down table of the present invention.

Referring to FIG. 9, the vacuum hold-down table 36 of the present invention is illustrated. Vacuum hold-down table 36 is fabricated in laminate layers such as, for example, foam including Styrofoam type SM which is a builders grade of Styrofoam. In the preferred embodiment, six layers of Styrofoam comprising layers 542, 544, 546, 548, 550 and 552 are utilized to form a laminated monolithic body generally identified by the numeral 560 (FIG. 7) for vacuum hold-down table 36. Each layer of body 560 is composed of segments, such as layer 546 including segments **546*a*, 546*b*, 546*c* and 546*d*** of foam material that is integrally bonded using an epoxy such as aircraft epoxy.

Disposed adjacent the upper surface of foam layer 542 is a layer of cloth such as, for example, Dacron or fiberglass 562. Disposed adjacent layer 562 is a layer of Formica 564. Layer 562 adds rigidity and provides additional strength for Formica layer 564.

Disposed adjacent the lower surface of foam layer 552 is a layer of cloth such as Dacron or fiberglass comprising layer 566. Disposed adjacent the lower surface of layer 566 is a layer of Formica 570.

An important aspect of the present table 36 is top surface 38 of vacuum hold-down table 36 disposed on the upper surface of Formica layer 564. Top surface 38 comprises a relatively low porous sheet 574 and may comprise, for example, shoe liner, porox plastic sheetings manufactured by the Porox Division of Glasrock of Fairburn, Georgia. Sheet 574 is easily replaceable should it become damaged during a cutting or plotting operation utilizing automatically controlled instrument system 20 (FIG. 1).

Body 560 comprising foam layers 542, 544, 546, 548, 550 and 552 together with cloth layers 562 and 566 and Formica layers 564 and 570 include a plurality of apertures 580 extending therethrough in alignment such that when vacuum pressure is applied to vacuum hold-down table 36, a flow of air is created from below Formica layer 570 through sheet 574 of surface 38 of vacuum hold-down table 36, such that a downwardly directed force is applied to sheet material 40 to maintain the material in a fixed position on the surface of vacuum hold-down table 36.

An important aspect of the present vacuum hold-down table 36 is the use of sheet 574 having low porosity as a top layer in combination with a number of sheets of greater porosity as the lower layers. This permits a more uniform vacuum pressure to be generated over the surface of vacuum hold-down table 36 to retain cut parts and sheet material such that the entire surface of vacuum hold-down table 36 need not be covered. The present vacuum hold-down table 36 utilizes a high vacuum pressure and a low flow rate to achieve the advantages of the present invention. A flow rate of 100 cfm at a pressure of 89 inches of water has been found satisfactory.

Sheet material and cut part retention is achieved utilizing the present invention by allowing a minimal air flow through the surface of the table when uncovered by sheet material to thereby maintain a high differential pressure between the vacuum source and the surface of the table. When sheet material or a cut part is placed on the surface of the table, this high differential pressure forces the sheet material or cut part into the surface of the table to achieve the desired high retention.

In manufacturing vacuum hold-down table 36, the layers are drawn together using an epoxy which is cured while a vacuum is applied to all layers. The manufacturing process of the present invention makes it possible to achieve an extremely flat surface for table 36. In this process, body 560 and the uniting layers of epoxy together with sheet 574 are positioned on a reference surface, such as a glass plate, where sheet 574 contacts the glass plate. Body 560 is essentially upside down from its position in vacuum hold-down table 36 so that the glass plate is positioned below the top surface of sheet 574. Body 560, sheet 574 and the glass plate are then enclosed by a nonporous material and a vacuum is effected, such that body 560 and sheet 574 are pressed downwardly toward the glass plate. The vacuum pressure acts as a mechanical press to press together all layers of body 560 and sheet 574 thereby generating an extremely flat surface for sheet 574 which assumes the flat surface characteristics of the glass plate.

The materials comprising vacuum hold-down table 36 are selected to be thermally matched. These materials include the foam layers, epoxy and housing to be subsequently described with reference to FIG. 10. The foam layers are relatively thin and are disposed in alternating directions as illustrated in FIG. 9 to minimize the memory of the material associated with the layers. Therefore, the layers form a unitary monolithic structure having a constant moisture absorption rate and matched thermal coefficients such that vacuum hold-down table 36 has minimum warpage.

FIG. 10 illustrates body 560 of vacuum hold-down table 36 disposed in a housing generally identified by the numeral 590. Housing 590 includes a sidewall 592 and endwalls 594 and 596. A bottom wall 598 is also provided for housing 590. Housing 590 may comprise, for example, plywood, which is treated to be sealed, such that there is no vacuum leak from housing 590. Disposed between bottom wall 598 and the lower surface of Formica 570 of body 560 is an air gap 600 which functions as a plenum. Plenum 600 serves to disperse the vacuum pressure throughout the entire body 560 of vacuum hold-down table 36.

Vacuum is applied through four vacuum ports, two of which are illustrated in FIG. 10 by reference numerals 602 and 604. Vacuum pressure is applied from a vacuum source (not shown) through air coils 608 and 610. The size of plenum 600 is selected such that the vacuum created within vacuum hold-down table 36 can be rapidly depleted in order to remove sheet material from the surface 38 of vacuum hold-down table 36 after a cutting or plotting operation has been completed by automatically controlled instrument system 20.

Vacuum hold-down table 36 is mounted to frame 440 using mounting plates 612 and 614 secured to the underside of bottom wall 598 of housing 590. Mounting plates 612 and 614 receive bolts 616 and 618 for threadedly engaging apertures within frame 440. The vacuum source (not shown) may be housed below vacuum hold-down table 36 within frame 160 (FIG. 1).

It therefore can be seen that vacuum hold-down table 36 comprised of laminate sections provides for a table that is flat, lightweight and free from the affects of humidity changes to thereby minimize warpage. The use of a high differential pressure results in a greater hold-down capability and does not necessitate that the entire surface of the table be covered with sheet material in order to retain the sheet material on a surface of a table. Vacuum hold-down table 36 is further economical to manufacture and maintenance free.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A vacuum hold-down table for holding sheet material in place comprising:

a plurality of layers united to form a laminated monolithic core portion for the table wherein said core portion has top and bottom surfaces;

a plurality of apertures extending throughout said core portion, such that air flows throughout said core portion;

a layer of relatively low porosity material disposed adjacent said top surface of said core portion;

a first layer of rigid material being disposed between said top surface of said core portion and said layer of relatively low porosity;

a plurality of apertures extending throughout said first layer of rigid material;

a vacuum source; and means for applying said vacuum source to said core portion to effect a vacuum within said core portion to thereby produce a predetermined flow rate of air passing through said plurality of apertures and a high differential pressure to maintain the sheet material in place on the surface of the table.

2. The vacuum hold-down table of claim 1 and further including:

a second layer of rigid material having top and bottom surfaces, said top surface being disposed adjacent said bottom surface of said core portion and united to said core portion; and a plurality of apertures extending throughout said second layer of rigid material.

3. The vacuum hold-down table of claim 2 wherein said plurality of layers comprise foam material.

4. A vacuum hold-down table for maintaining sheet material in place comprising:

a plurality of foam layers united to form a laminated core portion of the table wherein said core portion includes top and bottom surfaces;

a first layer of rigid material having top and bottom surfaces, said bottom surface being disposed adjacent said top surface of said core portion and united to said core portion;

a second layer of rigid material having top and bottom surfaces, said top surface being disposed adjacent said bottom surface of said core portion and united to said core portion;

said core portion and said first and second layers of rigid material forming a body portion for the table;

a plurality of apertures extending throughout said body portion, such that air flows throughout said body portion of the table;

a layer of relatively low porosity material disposed adjacent said first layer of rigid material to form a top surface of the table;

a vacuum source; and means for applying said vacuum source to said body portion to effectuate a vacuum within said body portion to create a high differential pressure and thereby maintain sheet material in place on the top surface of the table.

5. The vacuum hold-down table of claim 4 and further including:

a first layer of flexible material disposed between said first layer of rigid material and the top surface of said core portion of the table.

6. The vacuum hold-down table of claim 5 and further including:

a second layer of flexible material disposed between said second layer of rigid material and the bottom surface of said core portion of the table.

7. The vacuum hold-down table of claim 4 wherein said plurality of layers comprise Styrofoam having a porosity greater than the porosity of said layer forming said top surface of the table.

* * * * *